United States Patent [19]

Reis

[11] 4,057,699

[45] Nov. 8, 1977

[54] DENSITY CONTROL MONITOR WITH OPPOSING BELLOWS

[75] Inventor: Robert D. Reis, Hingham, Mass.

[73] Assignee: United Electric Controls Company, Watertown, Mass.

[21] Appl. No.: 648,042

[22] Filed: Jan. 9, 1976

Related U.S. Application Data

[63] Continuation of Ser. No. 459,462, April 10, 1974, abandoned.

[51] Int. Cl.[2] ..... H01H 35/32

[52] U.S. Cl. ..... 200/83 D; 200/81.5; 340/242; 73/393; 137/557

[58] Field of Search ..... 200/81.5, 81 R, 83 A, 200/83 D, 83 R, 83 C, 83 S, 83 Y, 81.8, 81.4; 340/229, 242, 240, 410; 137/557; 92/37, 38, 39; 73/410, 263, 393

[56] References Cited

U.S. PATENT DOCUMENTS

| | | | |
|---|---|---|---|
| 2,092,560 | 9/1937 | Runaldue | 137/311 |
| 2,187,346 | 1/1940 | Grace | 200/83 |
| 2,480,495 | 8/1949 | MeJean | 200/81.5 |
| 2,825,781 | 3/1958 | Mitchell | 200/81.5 |
| 2,849,577 | 8/1958 | Pfeiffer | 200/140 |
| 2,894,392 | 7/1959 | McLaughlin | 73/393 |

*Primary Examiner*—Gerald P. Tolin

*Attorney, Agent, or Firm*—Dike, Bronstein, Roberts, Cushman & Pfund

[57] ABSTRACT

A monitor for maintaining an atmosphere of gaseous sulfur hexafluoride supplied to the chamber of an outdoor circuit breaker at a predetermined density, which is to be kept constant, comprising a switch or valve operable to connect the chamber to a source of gaseous sulfur hexafluoride at said density and to disconnect it therefrom and a sensing device comprising a constant volume tube in the chamber filled with gaseous sulfur hexafluoride at the same density as that in the chamber, a compressible bellows in the tube filled with oil, a pair of opposed cascaded bellows supporting an actuator in operable relation to the switch or valve so as to maintain the switch or valve in a neutral position for any change in ambient temperature and wherein a decrease in pressure within the chamber will cause the switch or valve to be operated to supply gas pressure to the chamber.

6 Claims, 8 Drawing Figures

DENSITY CONTROL MONITOR WITH OPPOSING BELLOWS

This is a continuation of application Ser. No. 459,462 filed Apr. 10, 1974, now abandoned.

BACKGROUND OF INVENTION

The apparatus herein disclosed is designed to monitor and keep constant the density of a pressurized sulfur hexafluoride gas within large outdoor circuit breakers utilized by power companies. The gas is used as an arc-suppressant upon opening of the breaker contacts for the high pressure system and as an electrical insulator to prevent any current drain to the outer walls or any other grounded parts of the circuit breaker in the low pressure system. Because the dialectic strength of the gas is a function of the density, it is desirable and required that the latter must be kept constant. Since the density is a function of pressure, temperature and volume, these parameters must be dealt with in this type of control. According to the invention there are two models involved, one for high and one for lower pressure system. In both systems micro-switches or valves are used as disclosed in U.S. Pat. No. 3,490,342.

SUMMARY OF INVENTION

A monitor assembly for maintaining an atmosphere of gas supplied to a chamber at a predetermined constant density comprising a reference source of gas at said predetermined density, switch means operable to connect the chamber to said source and disconnect it therefrom, a sensing device in the chamber having the same expansion rate in respect to temperature changes as the gas in the chamber and means operable by the expansion of the sensing device and the gas within the chamber to oppose operation of the switch means, said latter means being operable by a dimunition of the pressure in the chamber to effect operation of the switch means in a direction to connect the chamber to said source. The sensing means comprises a sealed tube filled with a like gas at the same temperature and pressure and hence the same density as that in the chamber and expansion of the gas within the sealed tube takes place coincidentally with the expansion of the gas in the chamber to maintain the switch means in a neutral position. Optionally there may be a compressible element in the sealed tube filled with an incompressible liquid and means for connecting the compressible element when compressed by expansion of the gas within the sealed tube in opposition to the expansion of the gas in the chamber to maintain the switch element in said neutral position. The switch means may be a micro-switch or a valve. The switch means when in the form of a micro-switch operates to open a valve or start a pump connected to the source of pressure to deliver it to the chamber and to close the valve when the pressure reaches the predetermined pressure employed in the system and when the switch means is a valve the latter may be operated directly to admit and cut off the supply of pressure to the chamber. An actuator is employed in either case supported with an end adjacent to the switch or valve and with its other end opposite a transmitter. A pair of opposed pressure responsive elements support the transmitter for movement relative to the actuator and these are connected respectively to the chamber and to the sensing tube so that a temperature change operates through the pressure responsive elements to hold the transmitter in neutral position, and hence to prevent actuation of the switch means and when there is a drop in pressure in the chamber to move the transmitter in a direction to supply pressure to the chamber.

The invention will now be described in greater detail with reference to the accompanying drawings wherein.

Figure 1:
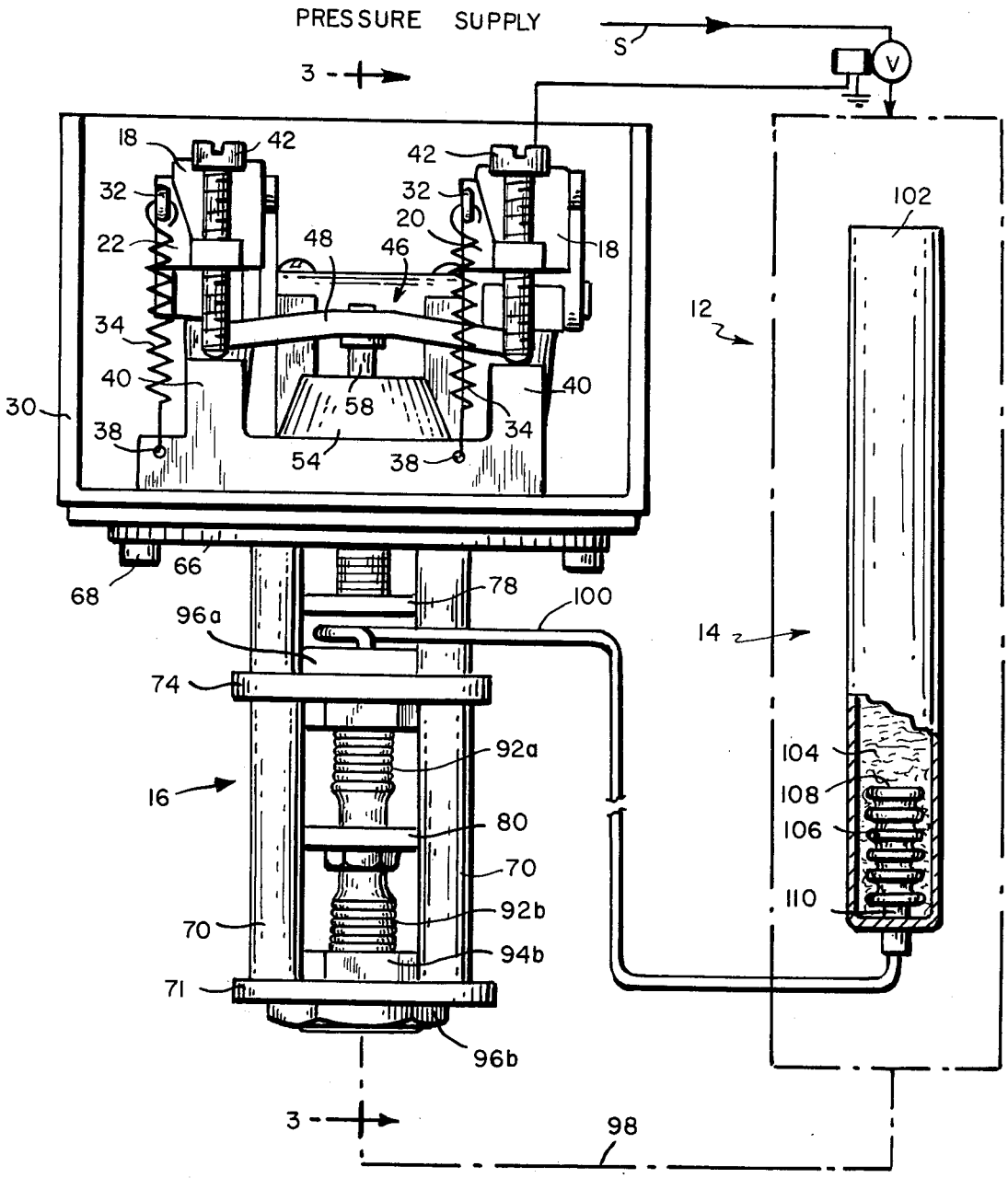
FIG. 1 is a front elevation of the monitor assembly with the cover removed from the box containing the switching means with other parts in section.
Figure 2:
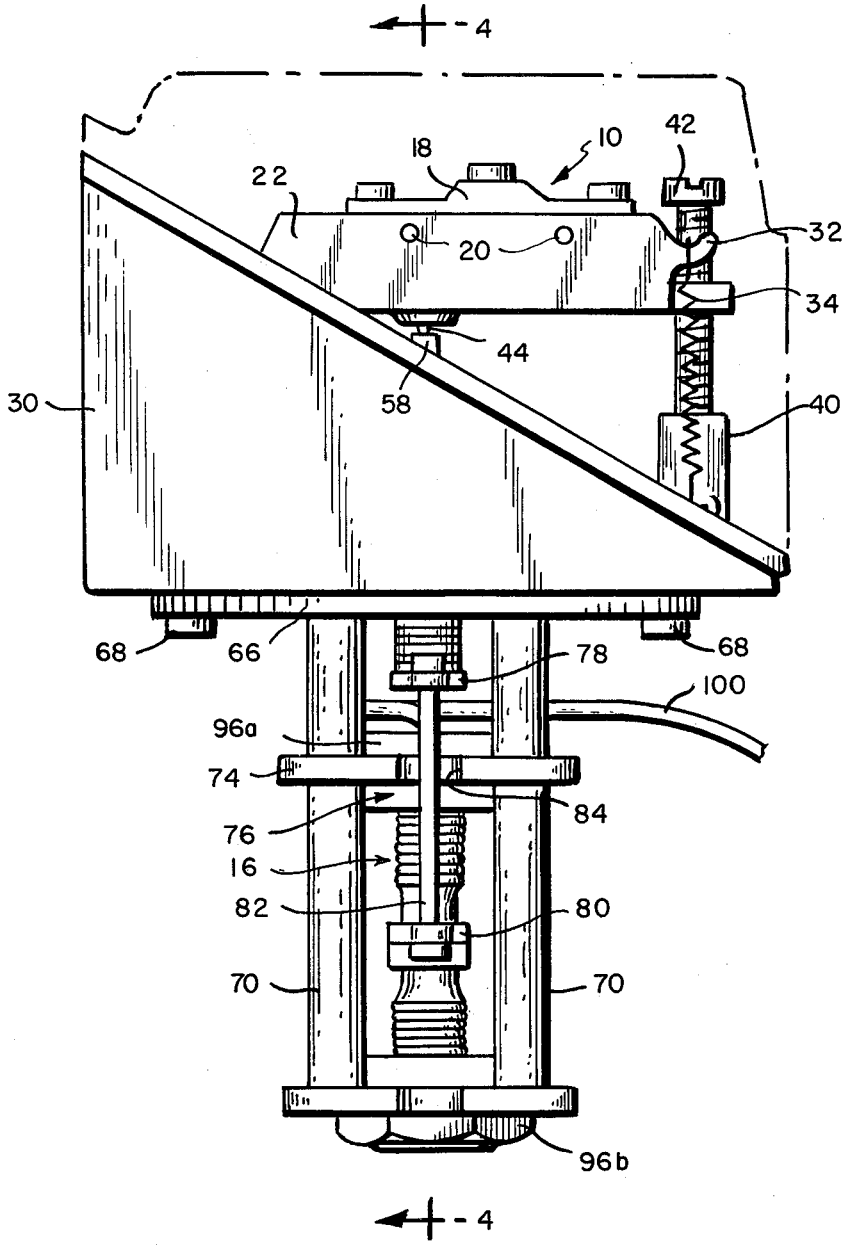
FIG. 2 is a side elevation of the assembly.
Figure 3:
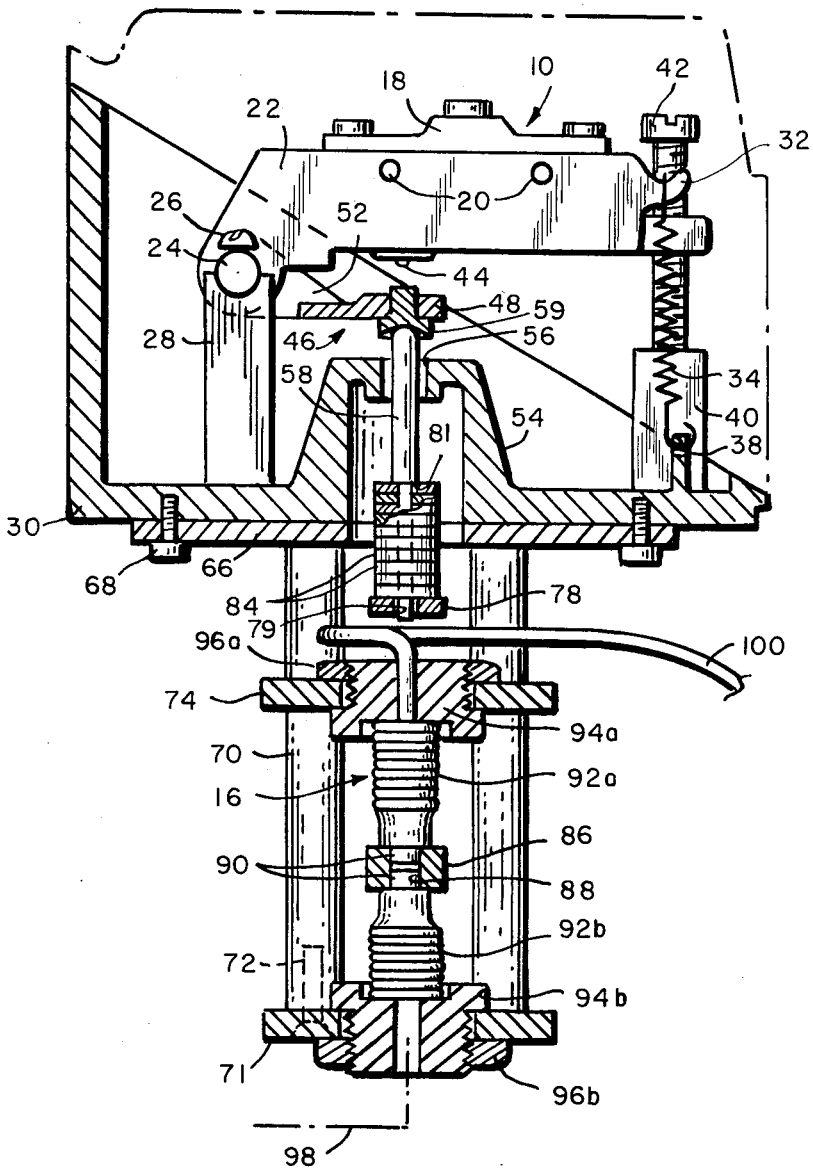
FIG. 3 is a vertical section taken from front to back and comprises a top view.
Figure 4:
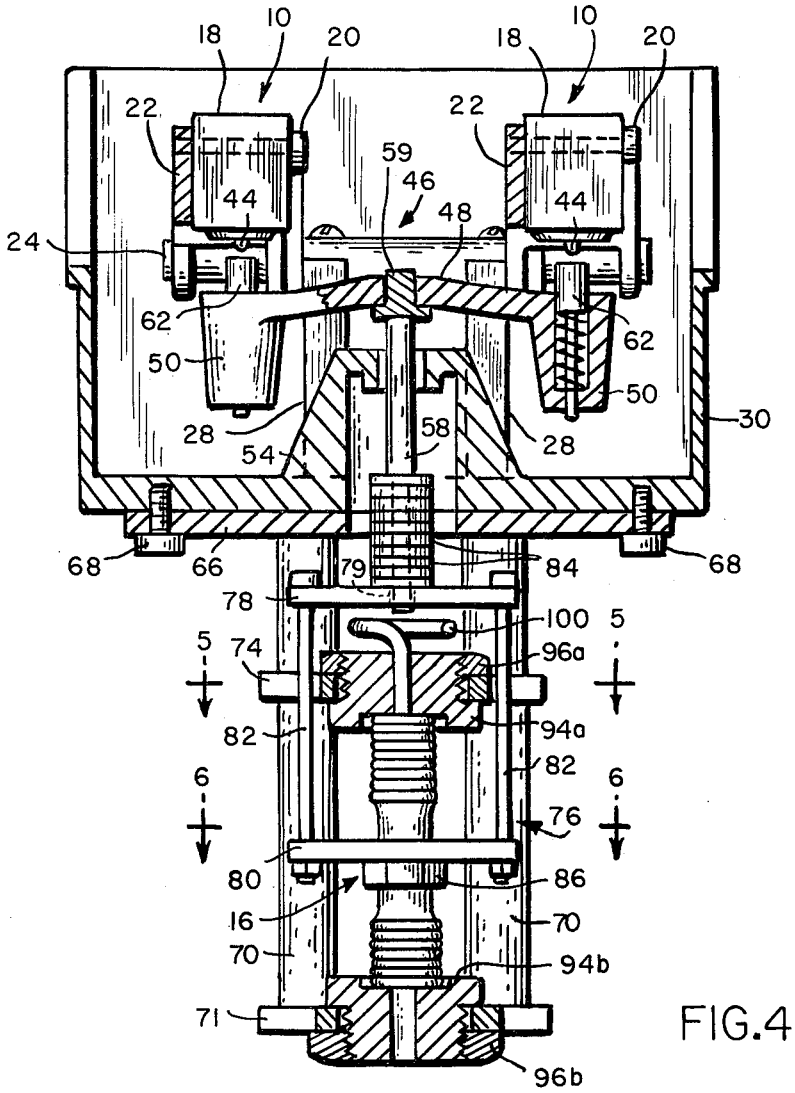
FIG. 4 is a vertical section taken transversely of the assembly.
Figure 5:
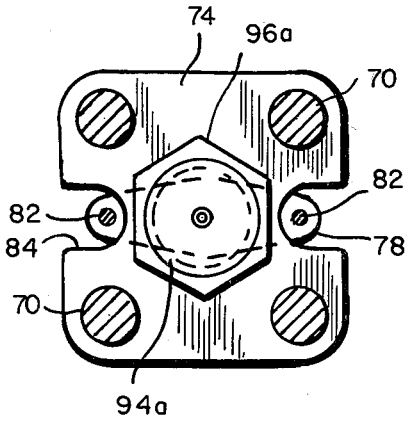
FIG. 5 is a section taken on the line 5—5 of FIG. 4.
Figure 6:
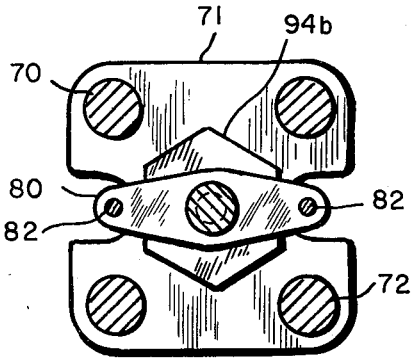
FIG. 6 is a section taken on the line 6—6 of FIG. 4.
Figure 7:
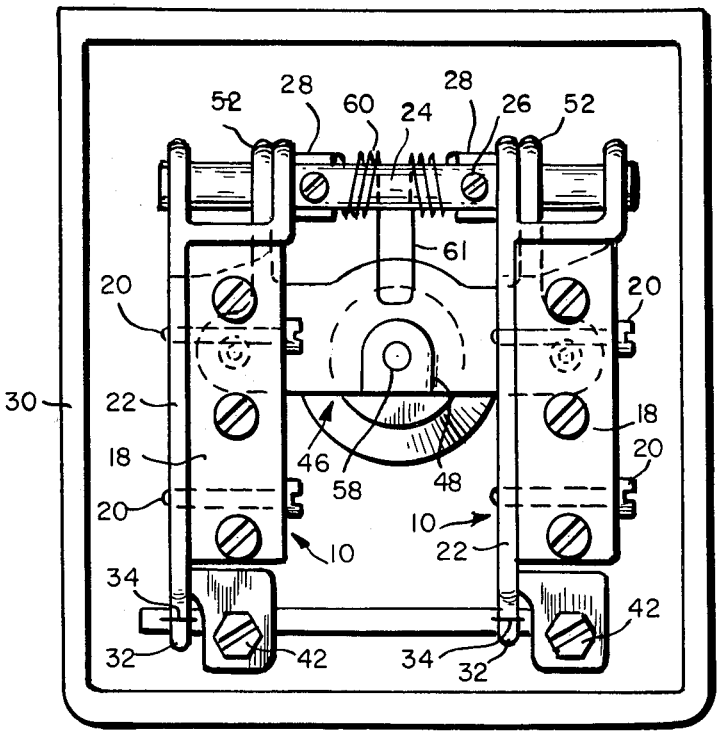
FIG. 7 is a top view.
Figure 8:
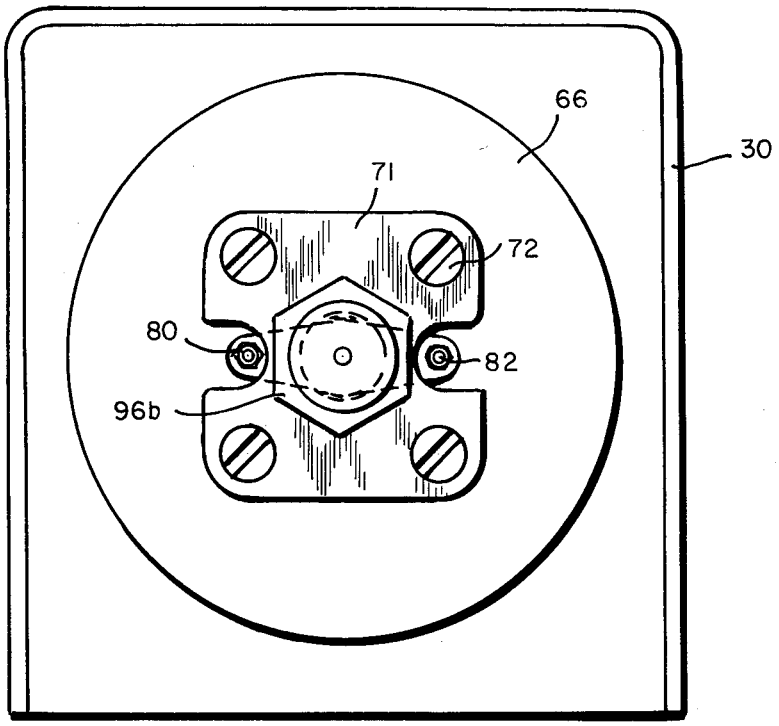
FIG. 8 is a bottom view.

Referring to the drawings the monitor comprises general switch means 10 provided with electric-micro-switches or valves for controlling the supply of a gas to the high and or low pressure chamber 12 of an outdoor circuit breaker such as utilized by power companies and in which it is desirable to maintain gaseous sulfur hexafluoride (SF6) for the purpose of arc suppression in the high pressure system and as an electrical insulator in the low pressure system. The dialectic strength of the gas is a function of density and the latter must be kept constant in order to be effective. To maintain the density constant there is provided a sensing device 14 which is located in the chamber of the circuit breaker and transmitter means 16 which immunizes the apparatus to temperature changes within the system while effecting operation of the switch means in the event that a leak develops so that the system fails to supply gas to the chamber.

The switch means 10 as herein illustrated comprises two micro-switches 18—18 each of which is secured by screw bolts 20 to an arm 22, the latter being pivotally supported at one end on a shaft 24, the shaft in turn being fastened intermediate its ends by screw bolts 26 to vertically disposed spaced parallel posts 28—28 rising from the bottom of a rigid box 30. The opposite ends of the arms 22—22 are provided with hooks 32—32 and coil springs 34—34 are looped at one end about these hooks and at their other ends engaged within holes 38—38 provided at the bottom of the box 30. The springs urge the arms downwardly. Posts 40—40 at the bottom of the box directly below the ends of the arms with which screw threaded bolts 42—42 threaded into the ends of the arms engage limit the position of the arms. By rotating the screws 42—42 the arms may be raised or lowered relative to their pivot axis. Each of the switches 18 has a downwardly extending actuating pin 44. It is to be observed that a valve provided with an actuating pin may be substituted for one or both of the switches 18—18. There is also mounted on the shaft 24 a yoke shaped member 46 comprising a bridge 48 and symetrically disposed downwardly extending spaced parallel sleeves 50—50 having rearwardly extending spaced parallel arms 52—52 which are pivotally mounted on the shaft 24. At the bottom of the box there is an upwardly projecting boss 54 over which the bridge 48 is centered and which contains a central hole within which there is vertically slidable an actuator rod 58, the upper end of which is supported by the boss directly beneath the bridge 48 mid-way between its opposite ends in engagement with the downwardly facing concave surface of a button 59 set into the bridge. A spring 60 coiled about the shaft 24 with a loop 61 intermediate its ends and bearing against the upper side of the bridge 48 yieldably presses the yoke downwardly toward the top of the boss and coincidentally forces the actuator rod 58 downwardly. The sleeves 50—50 which are located directly below the switches 18—18 each contain a spring biased pin 62 the upper end of which is adjacent the actuating pin 44 of the switch, and the lower end of which is free to move through the lower end of the sleeve when the yoke is raised relative to the arms supporting the switches thereabove so as to provide for override.

The actuator rod 58 extends downwardly through the boss 54 and through the bottom of the box and its lower end is supported on the transmitter assembly 16 as will now be described. The transmitter assembly is secured to the underside of the box on a flat circular plate 66 fastened to the bottom by screw bolts 68. Four quadralaterally spaced vertically disposed posts 70 are secured at their upper ends to the lower side of the plate 66 so as to extend downwardly and perpendicularly therefrom and these posts are connected at their lower ends to a rigid flat plate 71 by means of screw bolts 72. Intermediate the upper and lower ends of the posts there is a second rigid plate 74 of rectangular configuration containing holes at its corners through which the posts pass which provide for making a rigid structure. A transmitter 76 is mounted within the framework of the posts and comprises spaced vertical parallel bars 78 and 80 connected at their opposite ends to each other by rods 82—82. Notches 84—84 are provided in the edges of the upper plate 74 through which the rods are free to move as the transmitter is moved vertically within the framework of the posts. The lower end of the actuator rod 58 rests upon the upper bar 78 which contains an oversize hole 79 therein and between the bar 78 and a shoulder on the actuator rod 58 there is a stack of thin bi-metallic discs 84. The lower bar 80 is secured to a coupling 86 containing a vertical passage 88 into which are fixed nipples 90—90 at the ends of cascaded bellows 92*a*, 92*b* which are of corresponding size. The open ends of the bellows 92*a*, 92*b* are sealed to screw threaded plugs 94*a*, 94*b* as by solder the latter being screwed respectively into the plates 71 and 74 and secured therein by nuts 96*a*, 96*b*. The plug 96*b* and hence the interior of the bellows 92*b* is connected by a capillary conductor 98 to the chamber 12. As a consequence of this connection if a leak develops in the chamber 12 so that the pressure drops in this chamber the bellows 92*b* will collapse downwardly moving the transmitter frame downwardly which in turn allows the actuator rod 58 to be moved downwardly. Downward movement of the actuator rod 58 lowers the yoke and hence disengages the pins 62 from the actuating pins 44 of the switches or valves 18. Actuation of one of the switches or valves 18 supplies pressure from a suitable source diagrammatically illustrated at S in FIG. 1 to the chamber. The other switches or valves may be employed to signal the supply and cut off of gas to the chamber when the pressure is restored to the predetermined pressure which has been selected for the purpose of this invention. The pressure in the chamber is communicated through the capillary tube 98 to the bellows 92*a* so as to expand it. Expansion raises the transmitter and the actuator rod 58 and hence the yoke, the latter in turn lifts the pins 62—62 into engagement with the actuating pins 44—44 to terminate the flow of gas from the source and extinguish the signal whether visual or audable.

In order to neutralize the effect of a change of ambient temperature on the monitoring assembly the upper bellows 92*a* is connected by way of the nipple associated therewith and a capillary tube 100 to the sensing device 14. The sensing device is in the form of a constant volume sealed tube 102 filled with a gas 104 corresponding to that which fills the chamber, the gas in this instance being sulfur hexafluoride (SF6) at the same temperature and pressure as that supplied to the chamber. In the lower part of the sealed tube 102 there is a compressible element 106 in the form of a bellows which has a closed end 108 and an open end 110, the open end being connected to the capillary tube 100. The bellows 106 is filled with oil so that a change in ambient temperature in the chamber 12 will cause expansion or contraction of the gas 104 in the tube 102 which in turn will collapse or expand the bellows 106. Compression of the bellows will force the oil through the capillary tube 100 into the bellows 92*a*. Since the sealed tube 102 is in the chamber 12 a rise in ambient temperature can cause a corresponding expansion of the gas in the chamber 12 and in the sealed tube 102. The pressure developed by the expanding gas in the chamber 12 is transmitted to the lower bellows 92*b* through the capillary tube 98 and the pressure developed by the gas 104 in the sealed tube is transmitted by the oil to the upper bellows 92*a*. The opposed pressures being equal the transmitter will remain in a neutral position.

Basically this monitoring control is designed to monitor and keep constant the density of pressurized sulfur hexafluoride (SF6) within large outdoor circuit breakers utilized by power companies, however, it is to be understood that it can be used in other systems for maintaining a predetermined density of gas in a predetermined operation uninfluenced by changes in ambient temperature. In this particular installation the gas is used as an arc suppressant upon opening of breaker contacts in the high pressure system and as an electrical insulator in the low pressure system. Because the dialectic strength and the thermo-resistivity of the gas is a function of the density the latter must be maintained constant.

The monitoring assembly described above is especially designed for high pressure installation where the SF6 is employed to suppress arcing. The bellows 106 is a metal bellows 5/32 of an inch in diameter and the tube 102 within which it is housed is filled with SF6 at the same pressure and temperature as that of the gas that is being monitored. The bellows 92*a*, 92*b* are also 5/32 of an inch in diameter. Because the control enclosure and capillary tubing may be exposed to outside ambients of changing temperature thus causing expansion and contraction of the oil filled system the bi-metal compensating discs are utilized between the actuator 58 and the transmitter.

In operation there can be two changing conditions (1) temperature changes due to ambients and (2) pressure change due to temperature change, leakage and application of the gas upon the breaker movement. When the ambient temperature changes the gas within the sealed tube will expand or contract (pressure change) causing the oil filled bellows to do the same thus transmitting motion hydraulically to the top bellows 92*a* of the pair of cascaded bellows. At the same time the gas within the chamber 12 undergoes the same reaction and since it is connected to the bottom bellows of the pair of cascaded bellows it will oppose the motion and the floating transmitter will not move. This is the temperature compensation portion of the control, that is because the pressure varies directly with temperature, density remains constant and no set point change is desired. In theory this is done because the SF6 gas in the tube was originally filled at the same pressure and temperature as the monitored gas thus making their densities the same and therefore, their pressure change rates the same. As previously mentioned the density is a function of the volume also but since the movement of the oil filled bellows can result in volume displacement which is very small compared to the volume of the tube it can be neglected. The volume of the chamber 12 of course does not change, therefore this parameter for practical purposes remains constant.

When the pressure within the chamber changes (diminishes) due to a leak or break the control functions as a pressure control, that is the bottom bellows 92*b* will retract the bellows downwardly causing the pins 62 to move away from the switches or valves thus actuating a valve or a compressor to supply pressure to the chamber 12. This is the desired action because when pressure drops the temperature remains constant and therefore the density becomes lower. The pressure in the sealed tube 102 does not change, therefore, there is no opposing force to this action.

For the low pressure system the same assembly is employed except that the oil filled bellows 106 is omitted so that the gas within the sealed tube 102 and the gas within the chamber 12 operate respectively on the bellows 92*a,* 92*b.* The bellows 92*a,* 92*b* are three-quarters of an inch ($\frac{3}{4}$ inch) in diameter. The reason for this is that the SF6 gas can be used with lower temperatures at lower pressure without liquifying and therefore the capillary can be subjected to the lower ambients. Actually the oil used in the high pressure system is a transmission vehicle only to keep the gas out of the exposed capillary. The larger bellows are required to develop more force at the lower pressure.

I claim:

1. The combination with a chamber filled with a gaseous medium at a predetermined temperature and pressure, of switch means, switch controlled means operable to supply a gaseous medium to the chamber and monitoring means for controlling operation of the switch to maintain the chamber filled with said gaseous medium at said predetermined temperature and pressure, said monitoring means comprising reciprocably movable pressure-responsive means, overriding means operable by said pressure-responsive means, said overriding means being interposed between the pressure-responsive means and said switch for effecting operation of the switch, a sensing element in the chamber, said sensing element comprising a sealed tube containing a gaseous medium at the same temperature and pressure as that in the chamber, displaceable means in the sealed tube responsive to a change in pressure therein, means responsive to the displacement of the displaceable means in the sealed tube to move the pressure-responsive means proportionately in one direction and conductor means connecting the chamber to the pressure-responsive means for transmitting a change of pressure within the chamber to the pressure-responsive means to move it proportionately in the opposite direction.

2. Apparatus according to claim 1 wherein the displaceable means in the tube is a bellows supported in the tube.

3. Apparatus according to claim 1, wherein the pressure responsive means comprises cascaded bellows connected respectively to the sensing element and the chamber.

4. Apparatus for controlling the temperature and pressure of a gaseous medium in a gas-filled chamber comprising reciprocably movable pressure-responsive means, means operable by said pressure-responsive means to supply a gaseous medium to said chamber at said temperature and pressure and means for effecting reciprocal movement of the pressure-responsive means comprising a sensing element in the chamber within which the gaseous medium is to be controlled, transmitter means connecting the sensing element to the pressure-responsive means, said sensing element being responsive to a temperature change within the chamber to transmit pressure by way of said transmitter means to said pressure-responsive means to effect movement thereof in one direction, said sensing means comprising a sealed tube filled with a gaseous medium at the same temperature and pressure as that to be maintained in the chamber, and a displaceable member in the tube displaceable by a change in pressure within the tube, said displaceable member, when displaced by a change in pressure, operating to cause said transmitter means to transmit said pressure change in the tube to the pressure-responsive means to move it in one direction and conductor means connecting the chamber to the pressure-responsive means for transmitting a pressure change within the chamber to said pressure-responsive means to move it in the opposite direction.

5. Apparatus according to claim 4, wherein said pressure responsive means comprise opposed expandable elements for effecting movement of the pressure responsive means connected to said sensing element and connectable to said chamber respectively.

6. A monitoring assembly for maintaining a closed chamber filled with a gaseous medium at a predetermined temperature and pressure, said assembly comprising reciprocably movable, pressure-responsive means, a sensing element in the closed chamber comprising a tube filled with a gaseous medium at the same temperature and pressure as that to be maintained within the chamber, a bellows member mounted within the tube with one end free to move therein and the other end fixed, first conductor means connected at one end to the interior of the bellows at the fixed end and at its other end to one side of the pressure-responsive means, said bellows being responsive to pressure changes within the tube and second conductor means connected at one end to the chamber and at its other end to the other end of the pressure-responsive means and means operable by means of the pressure-responsive means in one direction to signal a depletion of the gaseous medium in the chamber at said predetermined temperature and pressure.

* * * * *